US010759203B2

(12) United States Patent
Otsuka et al.

(10) Patent No.: US 10,759,203 B2
(45) Date of Patent: Sep. 1, 2020

(54) RECORDING APPARATUS

(71) Applicant: SEIKO EPSON CORPORATION, Tokyo (JP)

(72) Inventors: Kazuo Otsuka, Azumino (JP); Yoshiyuki Okazawa, Shiojiri (JP); Tomoko Shirai, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/371,642

(22) Filed: Apr. 1, 2019

(65) Prior Publication Data

US 2019/0308429 A1 Oct. 10, 2019

(30) Foreign Application Priority Data

Apr. 5, 2018 (JP) ..... 2018-073230

(51) Int. Cl.

| | |
|---|---|
| ***B41J 29/02*** | (2006.01) |
| ***B41J 11/58*** | (2006.01) |
| ***B41J 13/10*** | (2006.01) |
| ***B41J 29/13*** | (2006.01) |
| ***B41J 29/00*** | (2006.01) |

(52) U.S. Cl.

CPC ..... *B41J 29/02* (2013.01); *B41J 11/58* (2013.01); *B41J 13/103* (2013.01); *B41J 13/106* (2013.01); *B41J 29/00* (2013.01); *B41J 29/13* (2013.01)

(58) Field of Classification Search

CPC ..... B41J 11/58; B41J 13/103; B41J 13/106; B41J 29/00; B41J 29/02; B41J 29/13

See application file for complete search history.

(56) References Cited

U.S. PATENT DOCUMENTS

2013/0188209 A1* 7/2013 Horikawa ..... H04N 1/00546 358/1.13
2014/0043410 A1* 2/2014 Nakano ..... B41J 2/17553 347/86
2018/0170064 A1* 6/2018 Higuchi ..... B41J 2/01

FOREIGN PATENT DOCUMENTS

JP 2017-017777 A 1/2017
JP 2017-030305 A 2/2017

* cited by examiner

*Primary Examiner* — Anh T Vo
(74) *Attorney, Agent, or Firm* — Workman Nydegger

(57) ABSTRACT

A recording apparatus includes: a recording section that performs recording onto a medium; an operation panel which is configured to be tilted to switch between a first position and a second position which is closer to a horizontal position than the first position is; and an open/close structure configured to be opened/closed, and configured to, when open, expose a space around a recording unit under the operation panel which has been tilted at least from the first position into a horizontal direction, and, when closed, close the space around the recording unit. The open/close structure has a pivot center in a lower part of the open/close structure in a closed state, and is configured to open forward relative to the apparatus with an upper part of the open/close structure in the closed state taken as a free end.

9 Claims, 16 Drawing Sheets

RECORDING APPARATUS

The present application is based on, and claims priority from JP Application Serial Number 2018-073230, filed Apr. 5, 2018, the disclosure of which is hereby incorporated by reference herein in its entirety.

BACKGROUND

1. Technical Field

The present disclosure relates to recording apparatuses that perform recording onto a medium.

2. Related Art

In recording apparatuses such as fax machines and printers, an operation panel that is tiltable may be provided on the apparatus front surface. JP-A-2017-030305 is an example of the related art. Since the operation panel provided on the apparatus front surface is tiltable, a user can operate the operation panel with an improved operability.

However, since the operation panel can be easily operated when it is in an open position, it may remain in that position for a long period of time. When the operation panel remains open to a certain degree for a long period of time, dust is likely to enter the inside of the apparatus, which may damage a function of the apparatus. On the other hand, when the inner side of the operation panel is formed of a fixed wall, a sufficient area cannot be ensured when a paper jam is removed from the apparatus front surface.

SUMMARY

According to an aspect of the present disclosure, in a configuration having a tiltable operation panel disposed on the apparatus front surface, reduction of dust or the like entering inside of the apparatus and improvement in accessibility to the inside of the apparatus are achieved.

According to an aspect of the present disclosure, a recording apparatus includes: a recording section that performs recording onto a medium; an operation panel which is provided to be tilted on an apparatus front surface, and is configured to be tilted to switch between a first position and a second position which is closer to a horizontal position than the first position is; and an open/close structure configured to be opened/closed, and configured to, when open, expose a space around a recording unit to be exposed under the operation panel which has been tilted at least from the first position into a horizontal direction, and, when closed, close the space around the recording unit.

According to the above aspect, the open/close structure configured to be opened/closed is provided, and configured to, when open, allow a space around the recording unit to be exposed under the operation panel which has been tilted at least from the first position into a horizontal direction, and, when closed, allow the space around the recording unit to be closed. Accordingly, it is possible to reduce dust or the like entering the inside of the apparatus when the open/close structure is closed, and to improve accessibility to the inside of the apparatus when the open/close structure is open. Further, a form of the open/close structure which is in a closed state closing the space around the recording unit is not limited to a form in which the open/close structure fully closes the space around the recording unit. It is only required that the open/close structure closes the space to a degree that can reduce dust or the like entering the space around the recording unit compared with the case where the open/close structure is in the open state.

In the aspect of the present disclosure, the open/close structure has a pivot center in a lower part of the open/close structure in a closed state, and is configured to open forward relative to the apparatus with an upper part of the open/close structure in the closed state taken as a free end.

According to the above aspect, the open/close structure has a pivot center in a lower part of the open/close structure which is in the closed state, and is configured to open forward relative to the apparatus with an upper part of the open/close structure in the closed state taken as a free end. Accordingly, compared with the opposite configuration, that is, a configuration in which a pivot center is located in the upper part of the open/close structure in the closed state, and a lower part of the open/close structure in the closed state is taken as a free end when the open/close structure is opened forward relative to the apparatus, the open/close structure is less likely to interfere with access to the inside of the apparatus to thereby ensure easy access to the inside of the apparatus.

In the aspect of the present disclosure, the open/close structure is configured to be open further downward from a horizontal plane. According to the above aspect, since the open/close structure is configured to be open further downward from a horizontal plane, the open/close structure is further less likely to interfere with access to the inside of the apparatus to thereby further ensure easy access to the inside of the apparatus.

In the aspect of the present disclosure, a medium receiving tray is provided under the open/close structure, the medium receiving tray being configured to receive a medium outputted after recording is performed on the medium, in which the free end of the open/close structure which is in an open state is supported by the medium receiving tray.

In the above aspect, the medium receiving tray is provided under the open/close structure, the medium receiving tray being configured to receive a medium outputted after recording is performed on the medium, in which the free end of the open/close structure which is in the open state is supported by the medium receiving tray. Accordingly, when an external force is applied to the open/close structure in the open state, the medium receiving tray can support the open/close structure to thereby suppress breakage of the open/close structure.

In the aspect of the present disclosure, a medium receiving tray is provided under the open/close structure, the medium receiving tray being configured to be displaced between a retracted position and a protruded position, which is a position protruded forward relative to the apparatus from the retracted position, and configured to receive a medium outputted after recording is performed on the medium, in which the open/close structure which is in an open state is supported by the medium receiving tray which is in the retracted position or supported by a frame which is exposed on the apparatus front surface.

According to the above aspect, the open/close structure which is in the open state is supported by the medium receiving tray which is in the retracted position or supported by a frame which is exposed on an apparatus front surface. Accordingly, when an external force is applied to the open/close structure in the open state, the medium receiving tray or the frame can support the open/close structure to thereby suppress breakage of the open/close structure.

In the aspect of the present disclosure, the open/close structure which is in the open state closes an output path for the medium outputted toward the medium receiving tray. According to the above aspect, the open/close structure which is in the open state closes an output path for a medium outputted toward the medium receiving tray. Accordingly, a user can easily notice that the open/close structure is open, which makes it possible to reduce the open/close structure being left open, and reduce dust or the like entering the inside of the apparatus. Further, a form of the open/close structure closing the medium output path is not limited to a form in which the open/close structure fully closes the medium output path. The open/close structure is not required to fully close the medium output path, but may only be required to interfere with the medium output path and to be in contact with a paper sheet which is outputted.

In the aspect of the present disclosure, an upper unit is disposed above the recording unit that includes the recording section, in which the free end of the open/close structure which is in the closed state is located at a position between the upper unit and the operation panel in an apparatus depth direction.

According to the above aspect, the upper unit is disposed above the recording unit, in which the free end of the open/close structure which is in the closed state is located at a position between the upper unit and the operation panel in an apparatus depth direction. Accordingly, the open/close structure can be prevented from being unintentionally opened.

In the aspect of the present disclosure, a lock unit that locks the open/close structure in the closed state is provided. According to the above aspect, since the lock unit that locks the open/close structure in a closed state is provided, the open/close structure can reliably remain closed.

In the aspect of the present disclosure, the open/close structure the open/close structure includes a hand grip. According to the above aspect, since the open/close structure includes the hand grip, operability in opening and closing the open/close structure is improved.

DESCRIPTION OF EXEMPLARY EMBODIMENTS

With reference to the drawings, an embodiment of a recording apparatus according to the disclosure will be described. In the following description, an ink jet printer 1 (hereinafter, simply referred to as a printer 1) is described as an example of a recording apparatus according to the disclosure. However, techniques of recording onto a paper sheet, which is an example of a medium, are not limited to an ink jet method, and may include various techniques such as electrophotographic method and dot impact method. The disclosure can be applied to any of the types described above. Further, ink jet type printers include various types such as a type in which an ink cartridge is mounted on a carriage, which is provided as a recording unit provided with a recording head, and a type in which an ink container is provided outside a carriage such that the ink container and the carriage are coupled via an ink tube. The disclosure can be applied to any of the types described above. The printer 1 according to the present embodiment is a type in which an ink container is provided outside a carriage such that the ink container and the carriage are coupled via an ink tube. Furthermore, ink jet type printers include various types such as a type in which a recording head is mounted on a carriage, which is movable in a direction perpendicular to a paper sheet transport direction, and a type in which a recording head formed in a size covering the entire area in the direction perpendicular to the paper sheet transport direction is not movable. The disclosure can be applied to any of the types described above. The printer 1 according to the present embodiment is a type having a movable carriage.

Throughout the drawings, the X-Y-Z coordinate system is indicated. The X axis direction represents an apparatus width direction and a paper sheet width direction, the Y axis direction represents a paper sheet transport direction in performing recording onto a paper sheet and an apparatus depth direction, and the Z axis direction represents an apparatus height direction and a gravity direction. Further, a direction in which a paper sheet is transported is referred to as "downstream", and a direction opposite to the downstream is referred to as "upstream". Furthermore, +Y direction is a direction oriented forward relative to the apparatus and −Y direction is a direction oriented backward relative to the apparatus.

Figure 1:
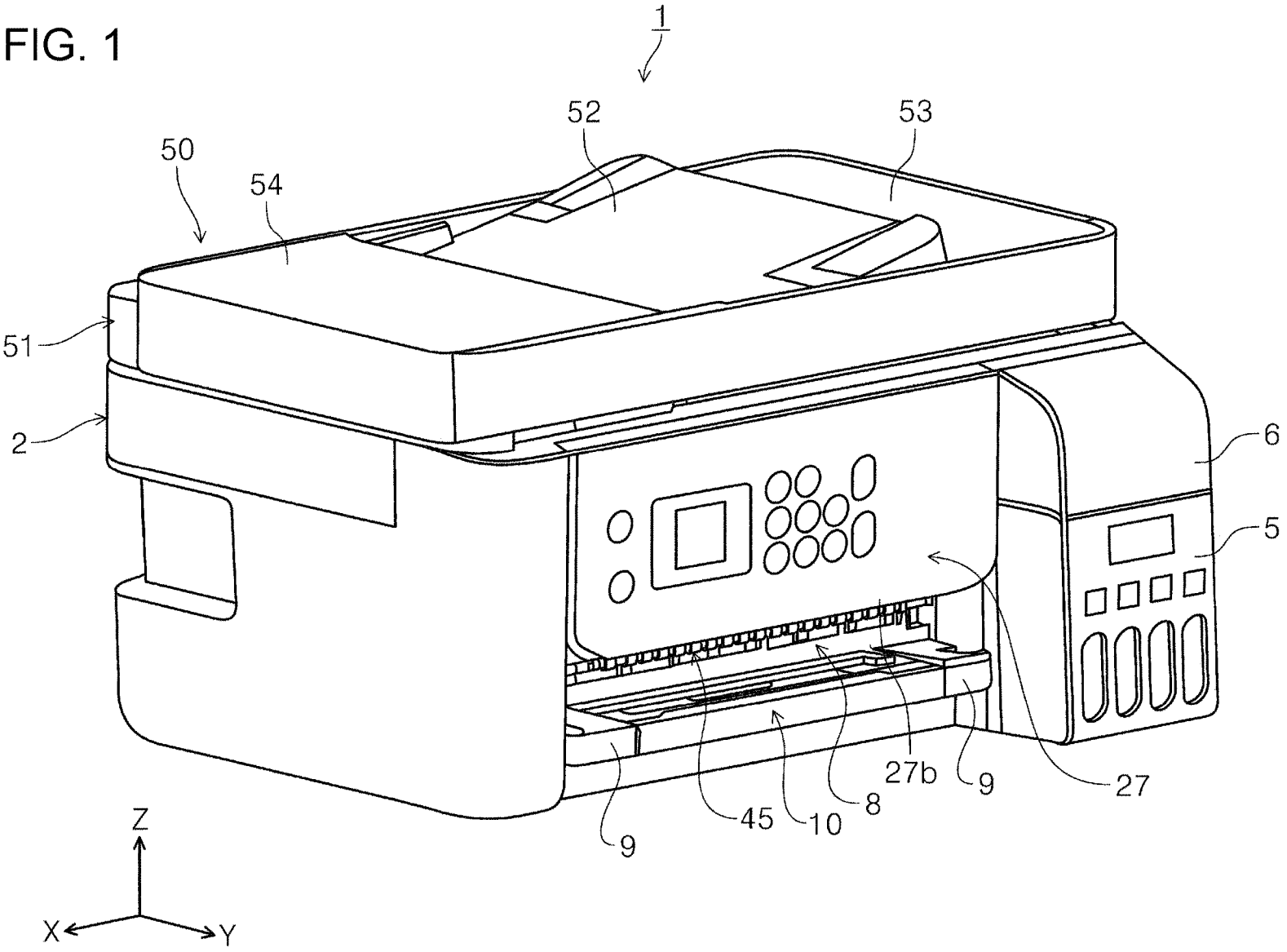
FIG. 1 is a perspective view of a printer according to the disclosure in which an operation panel is closed, a cover is closed, and a sheet output tray is housed.

The printer 1 illustrated in FIG. 1 includes an apparatus main body 2 having a recording function for performing recording onto a paper sheet, and a scanner unit 50, which is an example of an image reading apparatus for reading a document, and disposed on the upper part of the apparatus main body 2 as an upper unit. That is, the printer 1 is configured as a multi-functional machine. The scanner unit 50 is a so-called flatbed scanner, and includes an auto document feeding section 51 on the upper part of a reading unit 56 (FIGS. 5 and 6) having a reading sensor 55 (FIGS. 5 and 6) of a CCD (charge coupled devices) type or a CIS (contact image sensor) type so as to automatically feed a plurality of documents. Reference number 52 denotes a sheet feeding tray that constitutes an auto document feeding section 51, and a document which is set on the sheet feeding tray 52 is fed to a reading position by a feeding unit, which is not shown in the figure. Reference number 53 denotes a sheet output tray for receiving a document which is outputted after reading. Reference number 54 denotes a top cover configured to expose a document feed path. The auto document feeding section 51 per se is openable. When open, the auto document feeding section 51 exposes a document table, which is not illustrated in FIG. 1.

Figure 12:
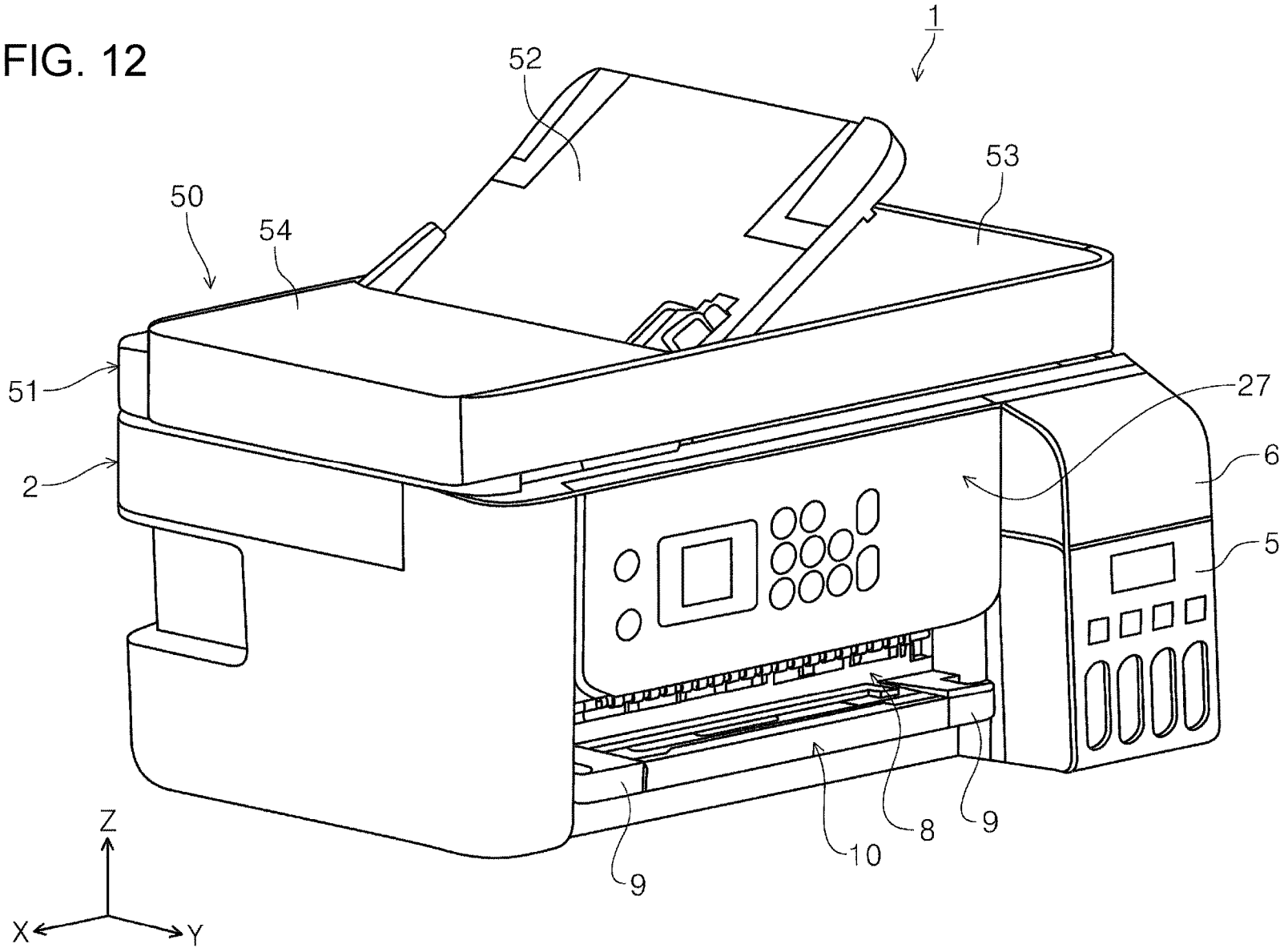
FIG. 12 is a perspective view of the printer according to the disclosure in which a sheet feeding tray of an auto document feeder is lifted.
Figure 13:
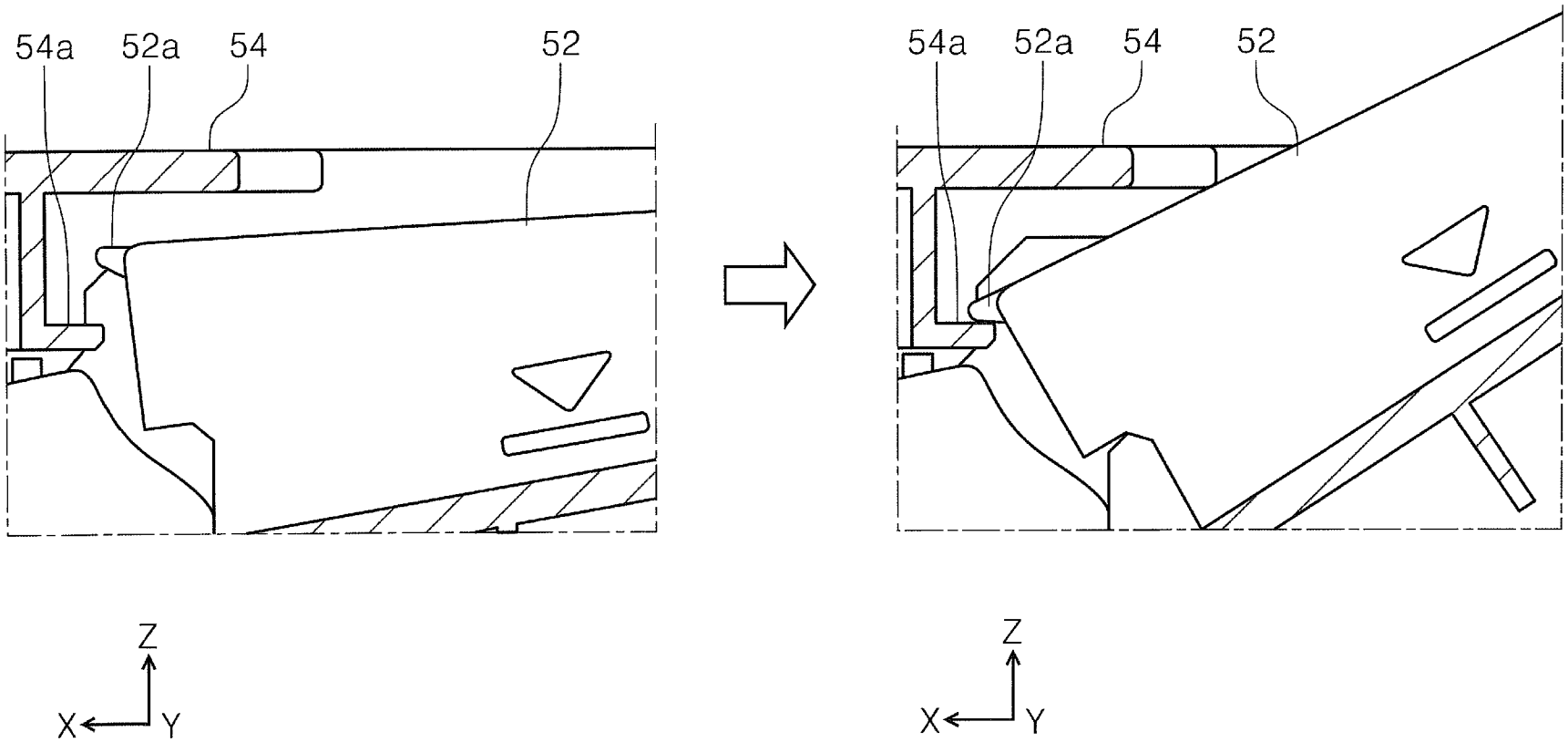
FIG. 13 is a sectional side view of a portion having the sheet feeding tray of the auto document feeder in the printer according to the disclosure in which is provided.

Further, the sheet feeding tray 52 is rotatable about a shaft (not shown) disposed at one end (+X direction end) such that a free end (−X direction end) of the sheet feeding tray 52 can be lifted as illustrated in FIG. 12, and this ensures that a document outputted onto the sheet output tray 53 is taken out. However, the sheet feeding tray 52, when rotated, may interfere with the top cover 54 and causes the top cover 54 to open. In view of this, as illustrated in FIG. 13, the top cover 54 is provided with an abutment section 54*a*, while the sheet feeding tray 52 is provided with a protrusion 52*a*. When the sheet feeding tray 52 is rotated, as illustrated by transition from the left view to the right view of FIG. 13, the protrusion 52*a* abuts the abutment section 54*a* to thereby push the top cover 54 downward. Accordingly, the top cover 54 can be prevented from being unintentionally opened when the sheet feeding tray 52 is lifted.

In addition, although the scanner unit 50 in the present embodiment is provided on the upper side of the apparatus main body 2, a configuration without having the scanner unit 50, that is, a configuration having a top plate instead of the scanner unit 50 may also be possible. Further, although the scanner unit 50 includes the auto document feeding section 51, a configuration without having the auto document feeding section 51, that is, a configuration having a cover that can expose a document table may also be used instead of the auto document feeding section 51.

In the present embodiment, the reading unit 56 (FIGS. 5 and 6) of the scanner unit 50 is pivotable relative to the apparatus main body 2 about a hinge (not shown) provided on the apparatus back side. When pivoting, the reading unit 56 can expose an upper side of the apparatus main body 2, while the free end of the reading unit 56 on the apparatus front side is fixed to the apparatus main body 2 by a fixation unit (e.g., a screw), which is not shown in the figure. That is, the scanner unit 50 is not designed to be pivotable by a user (apparatus user), but is designed to be pivotable by a serviceman (a person providing service and maintenance of the apparatus).

Figure 11:
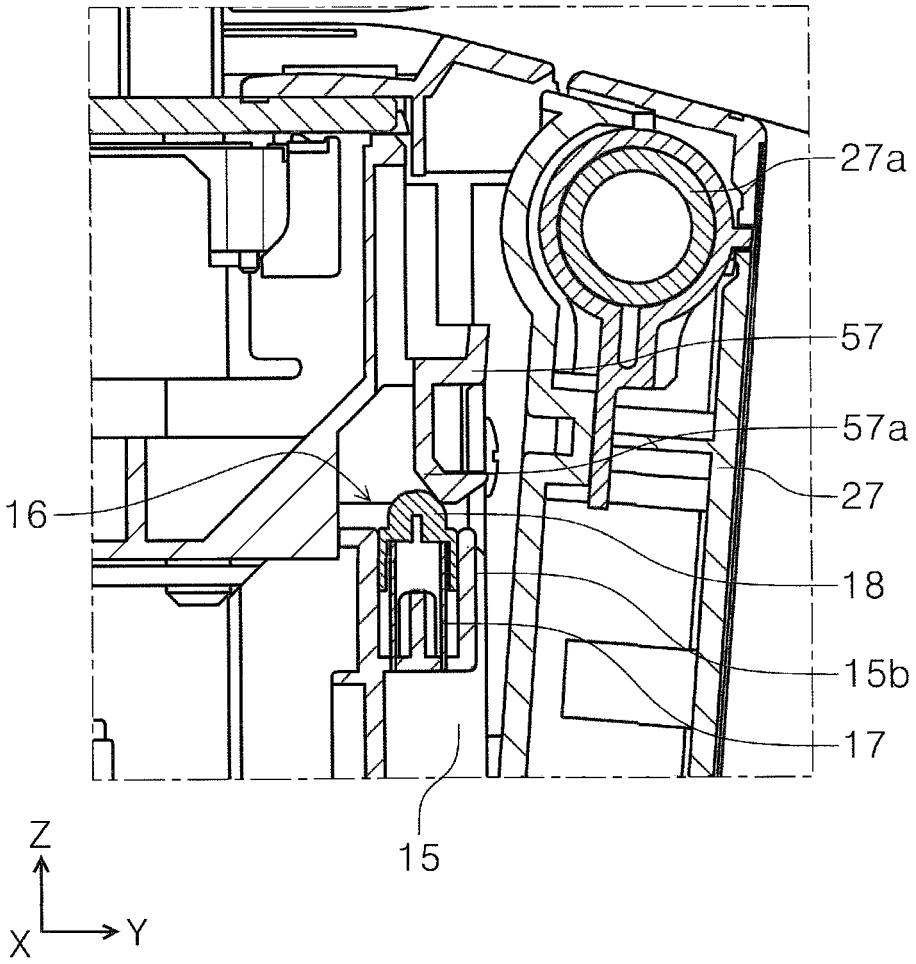
FIG. 11 is a sectional side view of a peripheral area of the cover end (lock pin) in the printer according to the disclosure in which the operation panel is closed, and the cover is closed.

Subsequently, an operation panel 27 is provided on the apparatus front surface. The operation panel 27 includes a plurality of operation buttons and a display. In the present embodiment, the operation panel 27 is configured as a user interface by which recording operation and image reading operation in the printer 1 are operated. The operation panel 27 is provided to be pivotable, that is, tiltable about a rotation shaft 27*a* (FIG. 11). The operation panel 27 can be tilted to thereby switch between a first position (FIG. 1) and a second position (FIG. 2), which is closer to the horizontal position than the first position is. In the following description, the first position of the operation panel 27 (FIG. 1) is referred to as a fully closed position, and the second position (FIG. 2) is referred to as a fully open position. In the present embodiment, a panel surface of the operation panel 27 in the fully closed position extends along a vertical plane, and a sheet output port 8 is provided under the free end 27*b*. Further, the panel surface of the operation panel 27 in the fully open position extends along a horizontal plane. In addition, the position of the operation panel 27 can be held by a position holding unit, which is not shown in the figure.

Figure 5:
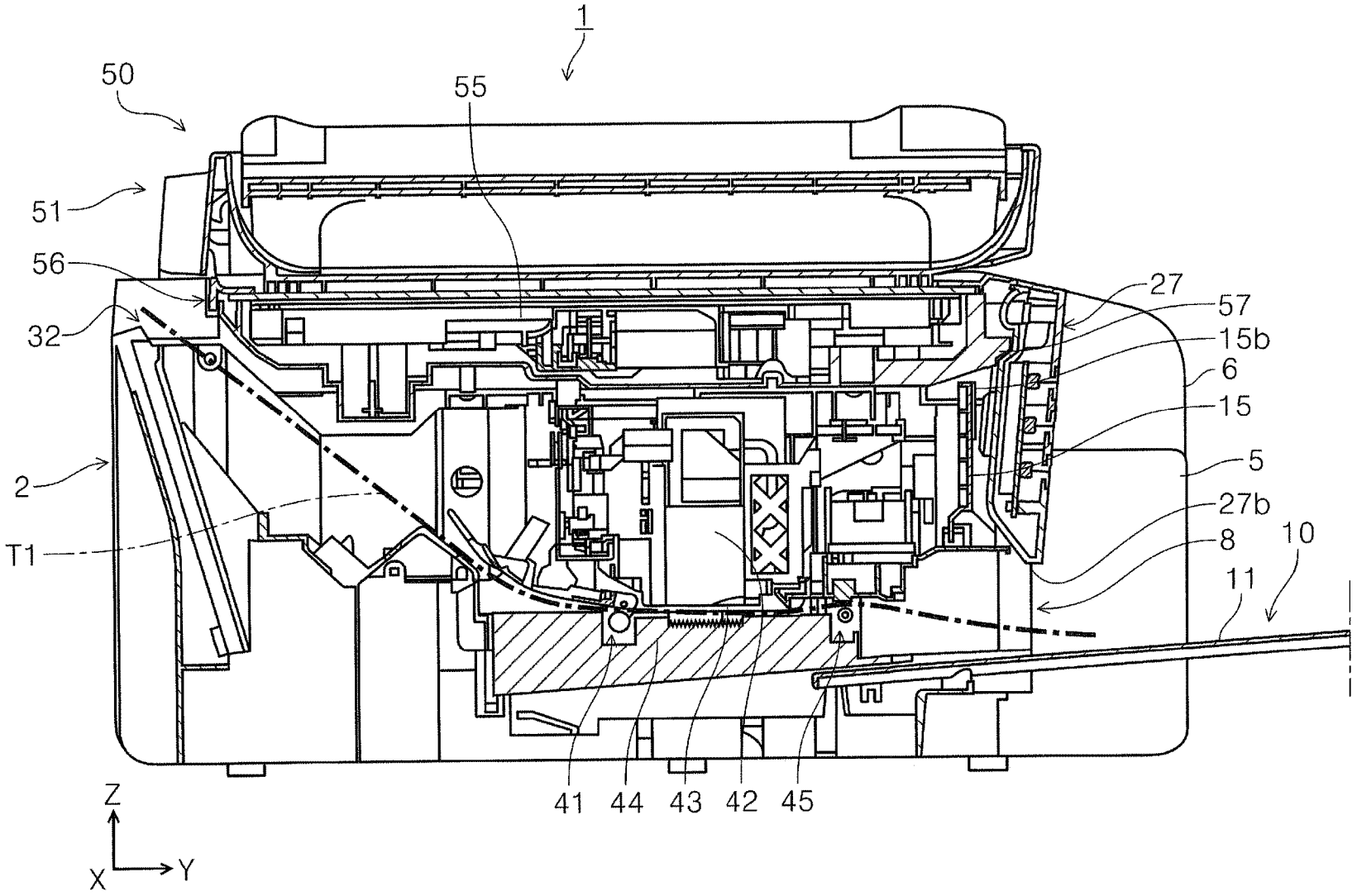
FIG. 5 is a sectional side view of the printer according to the disclosure in which the operation panel is closed, the cover is closed, and the sheet output tray is pulled out.
Figure 6:
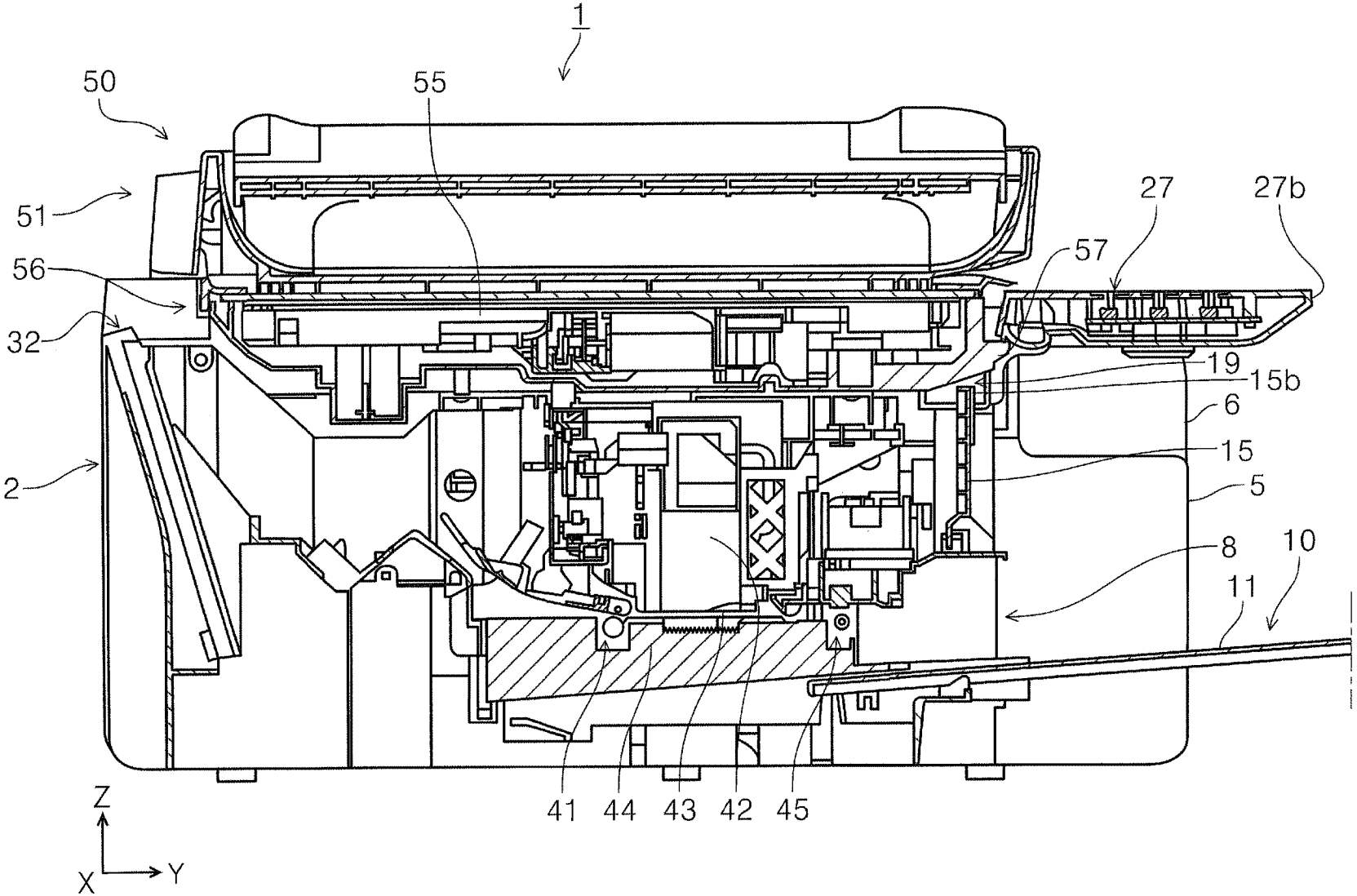
FIG. 6 is a sectional side view of the printer according to the disclosure in which the operation panel is open, the cover is closed, and the sheet output tray is pulled out.
Figure 14:
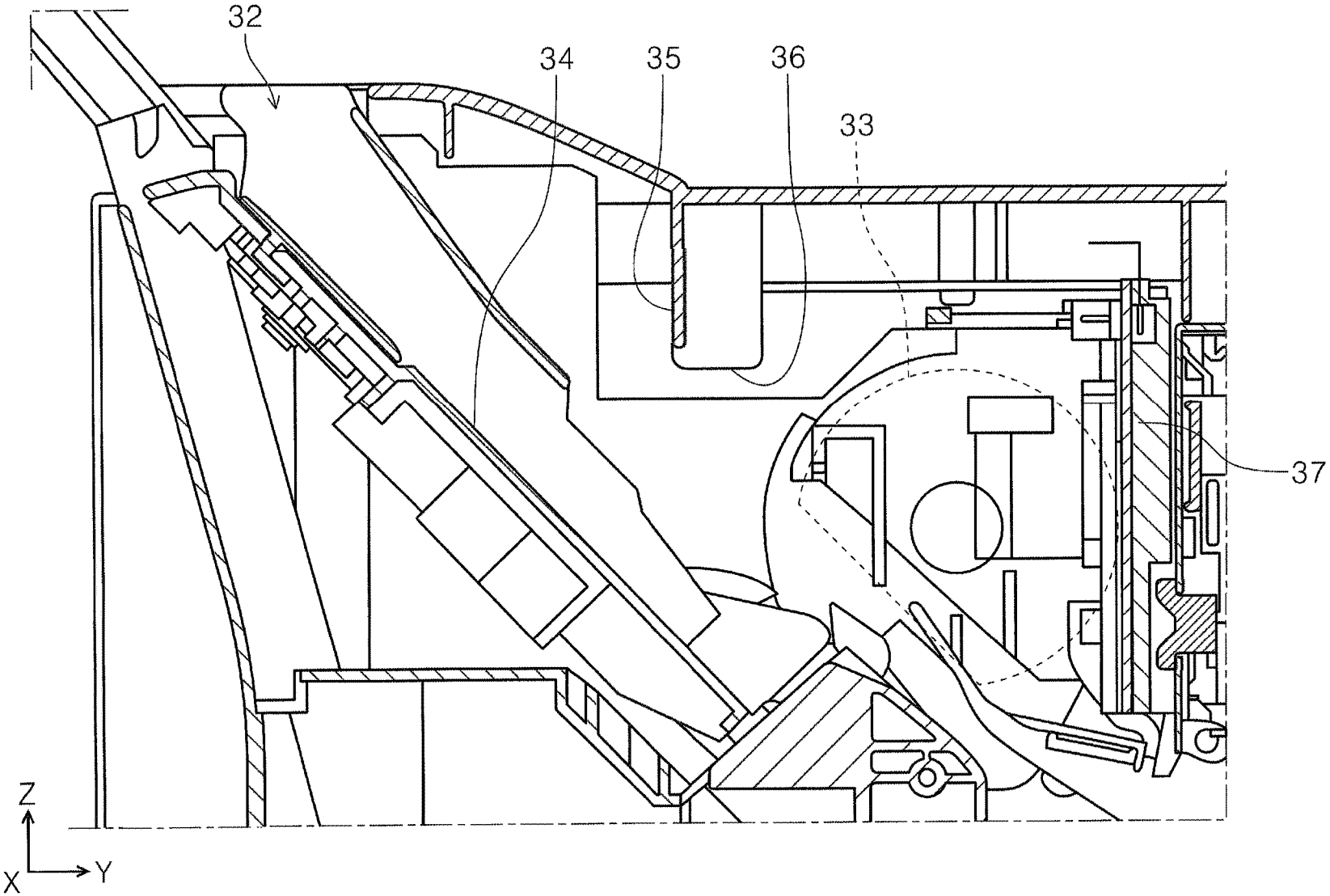
FIG. 14 is a sectional side view of a peripheral area of a sheet feeding port in the printer according to the disclosure.

Next, a configuration inside the apparatus main body 2 will now be described. In FIGS. 5 and 6, a sheet feeding port 32 is provided on the apparatus back side such that a paper sheet can be fed through the sheet feeding port 32. In FIG. 5, the dot and dash line T1 indicates the transport path of a paper sheet which is fed from the sheet feeding port 32 and undergoes recording. A paper sheet feeding unit, which is not illustrated in FIGS. 5 and 6, is provided inside the sheet feeding port 32. The paper sheet feeding unit includes a hopper 34 that support a paper sheet in an inclined position as illustrated in FIG. 14, and a feed roller 33 driven by a motor, which is not shown in the figure. Further, as illustrated in FIG. 15, the paper sheet feeding unit includes a separation roller 38 that cooperates with the feed roller 33 to nip a paper sheet for separation, and a return lever 30 that returns a leading end of a paper sheet from a position adjacent to the nip position between the feed roller 33 and the separation roller 38 toward the upstream.

Figure 15:
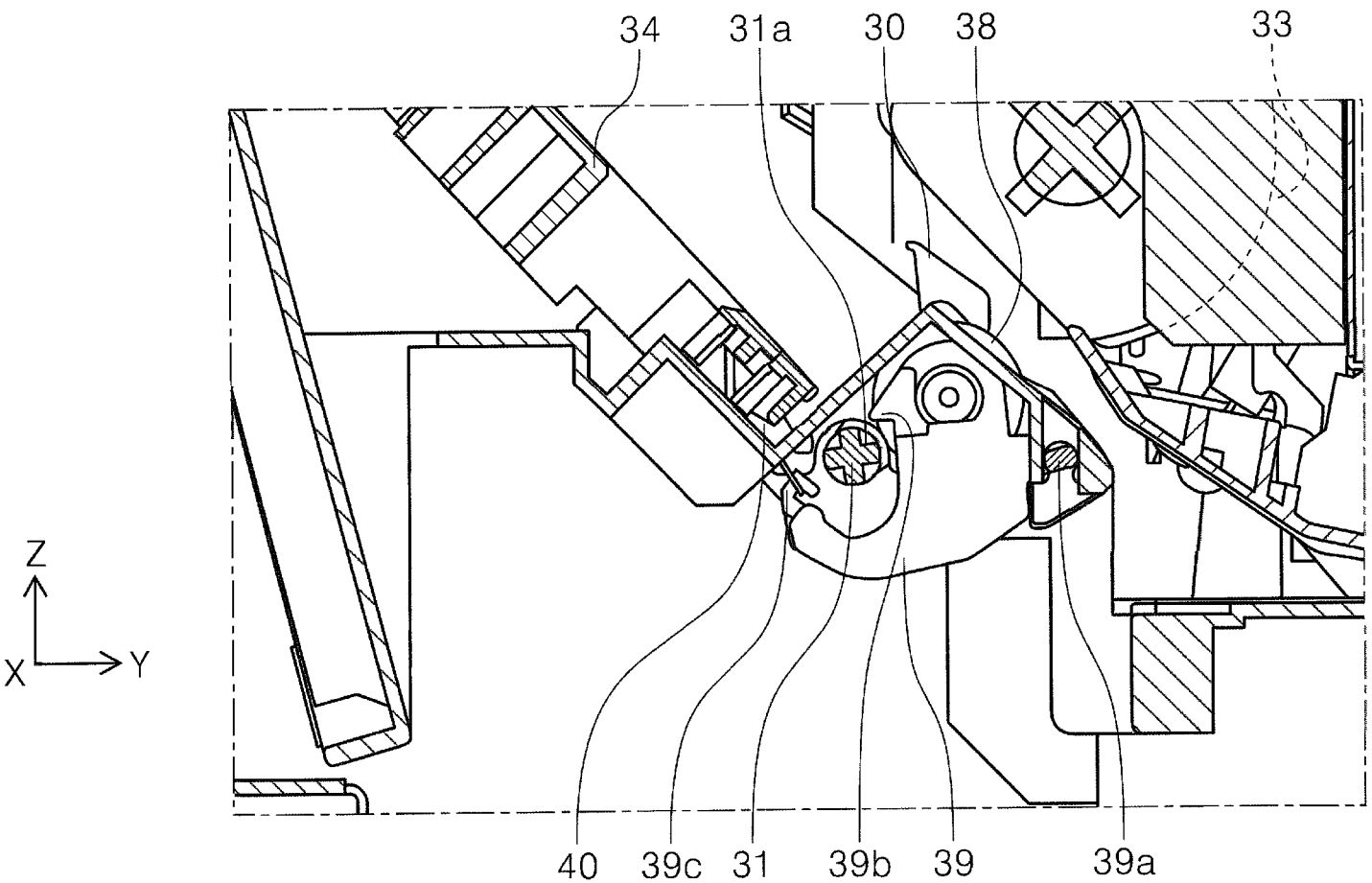
FIG. 15 is a sectional side view of a peripheral area of a feed roller in the printer according to the disclosure.
Figure 16:
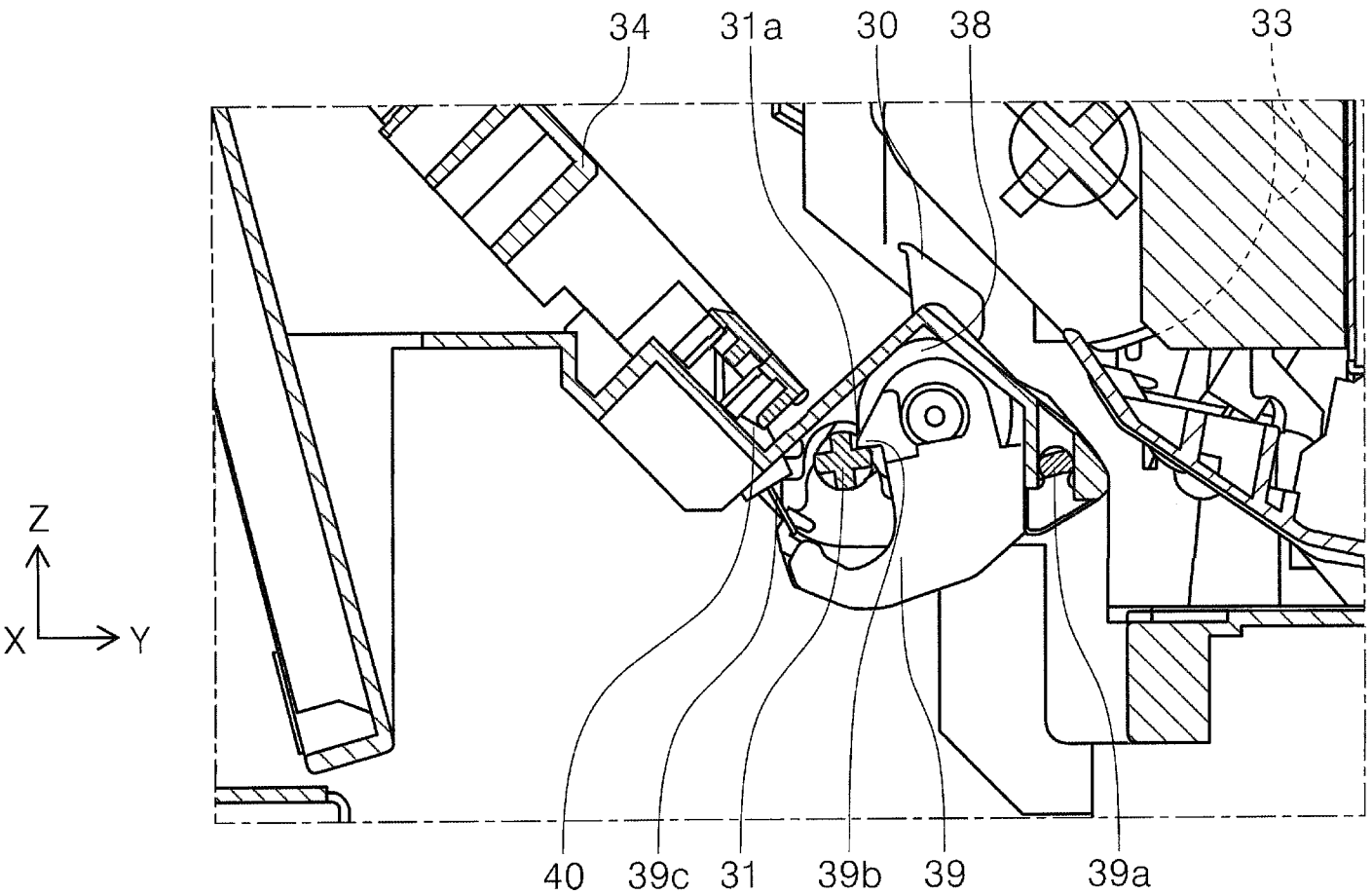
FIG. 16 is a sectional side view of a peripheral area of a feed roller in the printer according to the disclosure.

In FIG. 15, reference number 31 denotes a rotation shaft of the return lever 30, and reference number 39 denotes a roller holder that supports the separation roller 38 in a rotatable manner. The roller holder 39 is rotatable about the rotation shaft 39*a*, and is pressed by a spring 40 in a direction in which the separation roller 38 is biased toward the feed roller 33. Reference number 39*c* denotes a spring hook on which the spring 40 is hooked. Here, the roller holder 39 is accessible from under the apparatus. Accordingly, the roller holder 39 may be unintentionally pulled downward, which may cause the spring 40 to be elongated to a maximum or to be detached from the spring hook 39*c*. However, since the roller holder 39 is provided with a stopper section 39*b*, when the roller holder 39 rotates downward about the rotation shaft 39*a*, the stopper section 39*b* is caught by a recess 31*a* formed on the rotation shaft 31 of the return lever 30 so that downward rotation is regulated as illustrated by transition from FIG. 15 to FIG. 16. Accordingly, the spring 40 can be protected.

Further, as illustrated in FIG. 14, a plate shaped member 35 is provided above the hopper 34. The plate shaped member 35 serves as a block plate that causes the circuit board 37 not to be clearly viewed through the sheet feeding port 32. Here, providing the plate shaped member 35 may cause the leading end of the paper sheet which is in back feeding (the end which is a trailing end in recording) to be caught by the plate shaped member 35. In view of this, the plate shaped member 35 is provided with a rib 36 such that the rib 36 reduces the leading end of the paper sheet which is in back feeding, being caught by the plate shaped member 35.

Subsequently, referring back to FIGS. 5 and 6, a paper sheet which is inserted for feeding through the sheet feeding port 32 is nipped by a transport roller pair 41, and transported further downstream. On the downstream of the transport roller pair 41, a paper sheet support section 44 that supports a paper sheet, and a recording head 43, which is an example of a recording section that performs recording by ejecting ink, which is an example of liquid, onto a paper sheet are disposed to face each other. The recording head 43 is provided on a carriage 42, which is a recording unit, and the carriage 42 is reciprocated in a paper sheet width direction by a motor, which is not shown. Further, an ink container 5 (see also FIGS. 1 to 4) is provided on the right side on the front surface of the printer 1, and ink is supplied from the ink container 5 to the recording head 43 via an ink tube, which is not shown. The top of the ink container 5 is openable by an ink container cover 6, and when the ink container cover 6 is open, ink can be refilled into the ink container 5.

Figure 2:
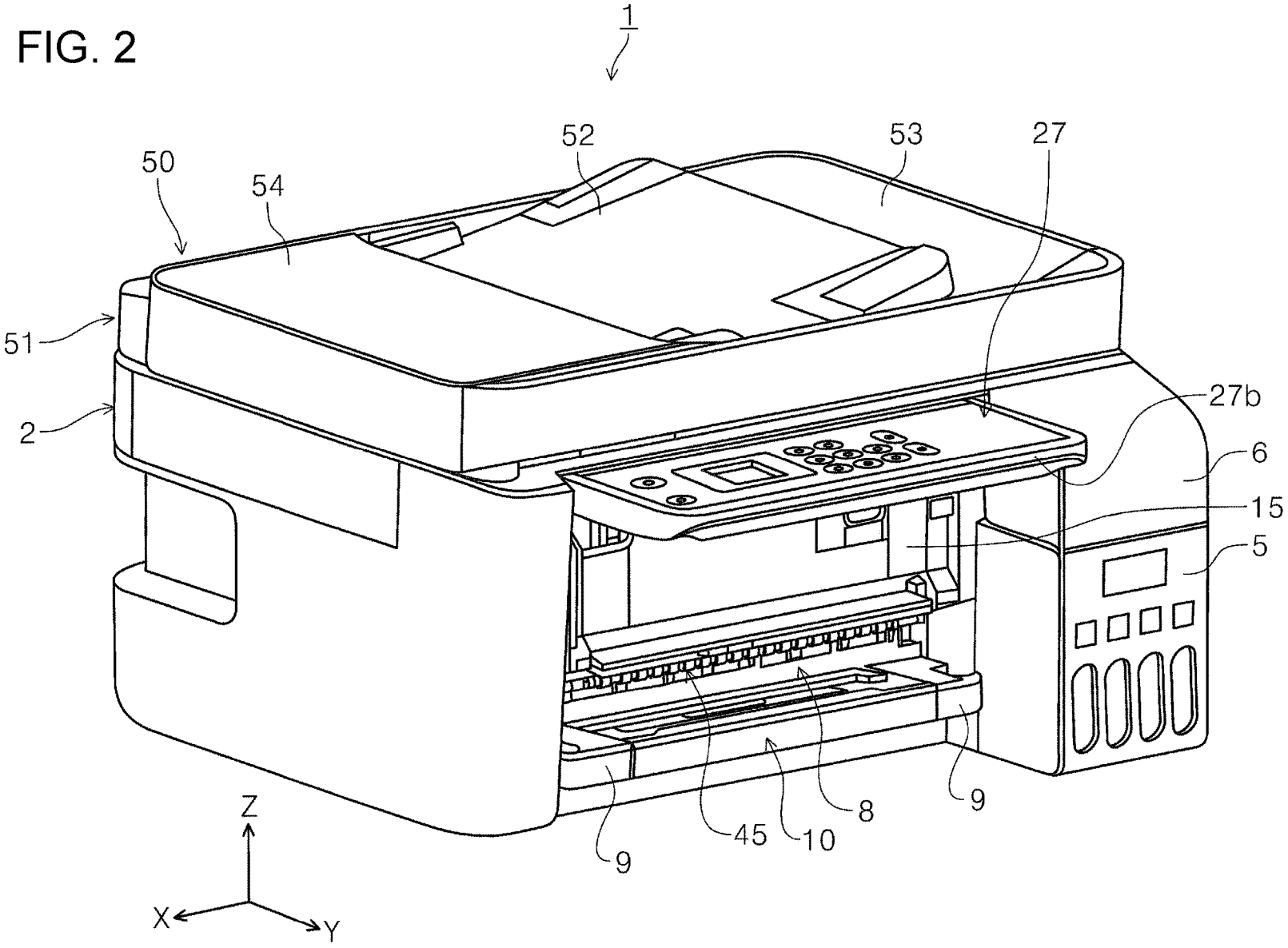
FIG. 2 is a perspective view of the printer according to the disclosure in which the operation panel is open, the cover is closed, and the sheet output tray is housed.
Figure 3:
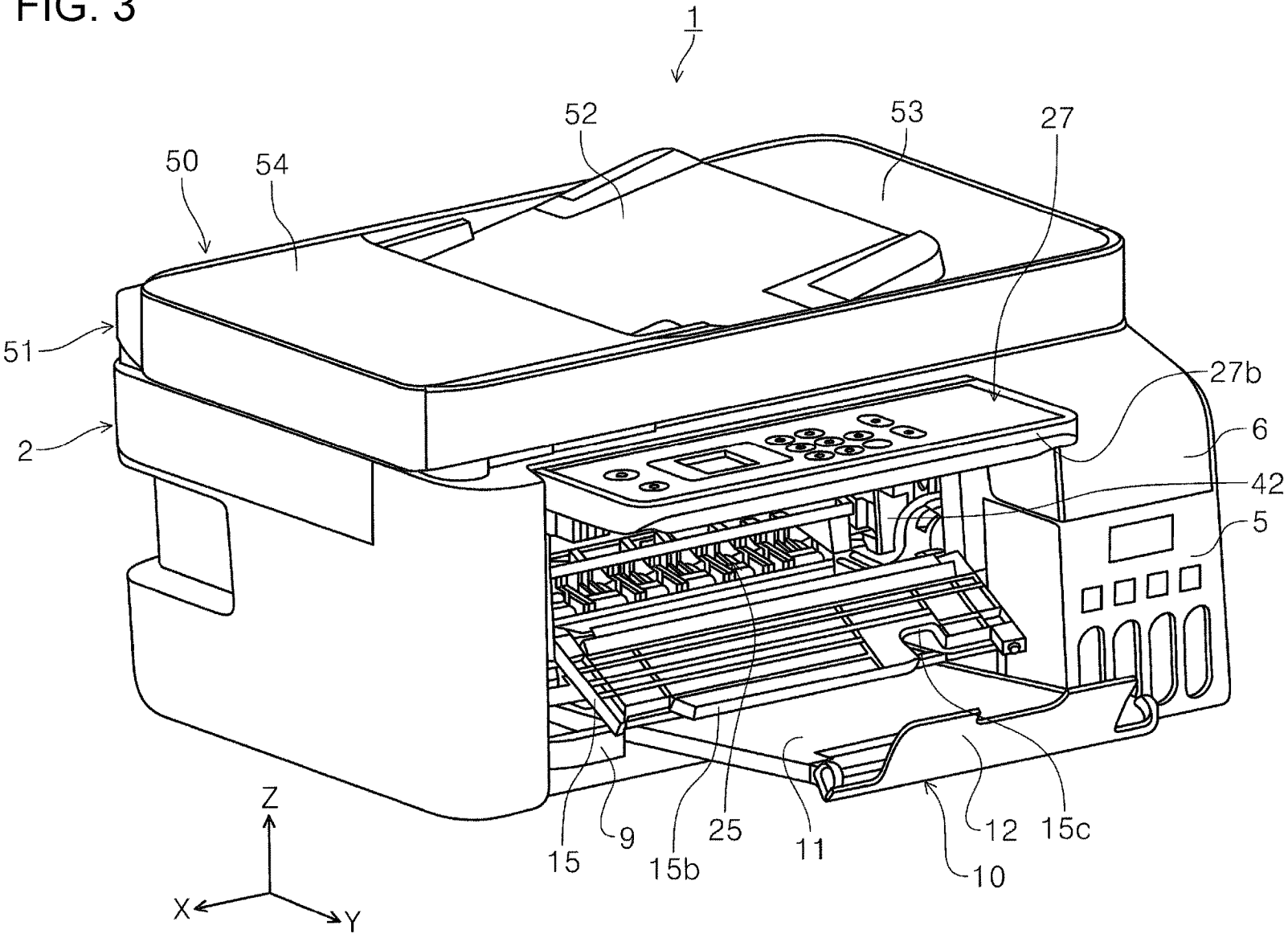
FIG. 3 is a perspective view of the printer according to the disclosure in which the operation panel is open, the cover is open, and the sheet output tray is pulled out.

On the downstream of the recording head 43, a discharge roller pair 45 is provided. After recording is performed, a paper sheet is outputted forward relative to the apparatus through the sheet output port 8 by the discharge roller pair 45. The paper sheet, which is outputted forward relative to the apparatus, is received by a sheet output tray 10. As illustrated in FIG. 3, the sheet output tray 10 is composed of a tray main body 11 and an extender tray 12, and is configured to be slidably displaced between a retracted position illustrated in FIGS. 1, 2, 4 and 8 and a protruded position illustrated in FIGS. 3, 5 to 7. The extender tray 12 is pivotable relative to the tray main body 11, and as illustrated in FIG. 3, when open, the extender tray 12 serves as a stopper that prevents an outputted paper sheet from being ejected out. Further, although the sheet output tray 10 in the present embodiment is configured to be pulled out and housed by a user, it may also be configured to be automatically slid by a power of motor, for example.

Figure 4:
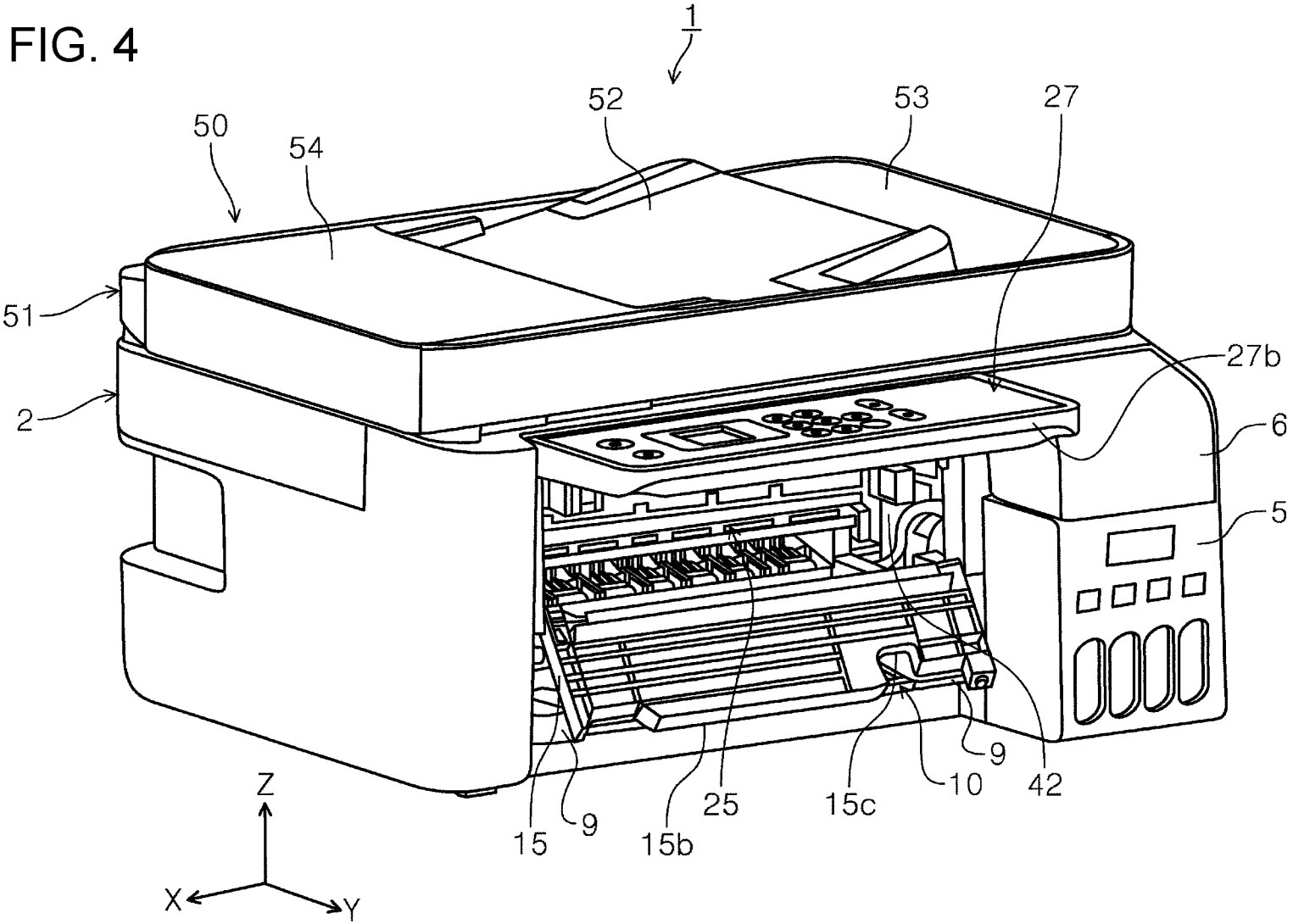
FIG. 4 is a perspective view of the printer according to the disclosure in which the operation panel is open, the cover is open, and the sheet output tray is housed.
Figure 7:
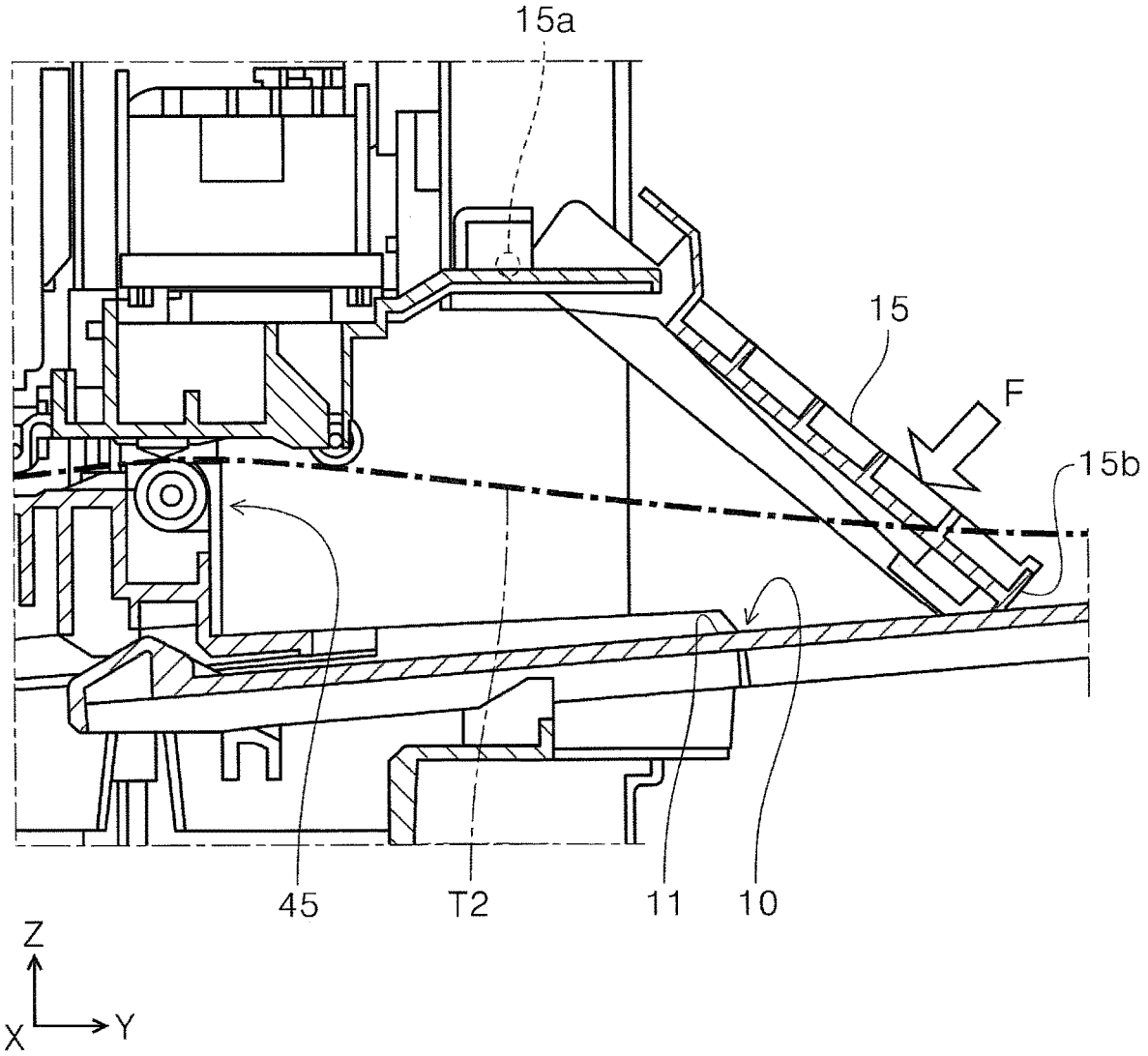
FIG. 7 is a sectional side view of a peripheral area of the cover in the printer according to the disclosure in which the cover is open, and the sheet output tray is pulled out.
Figure 8:
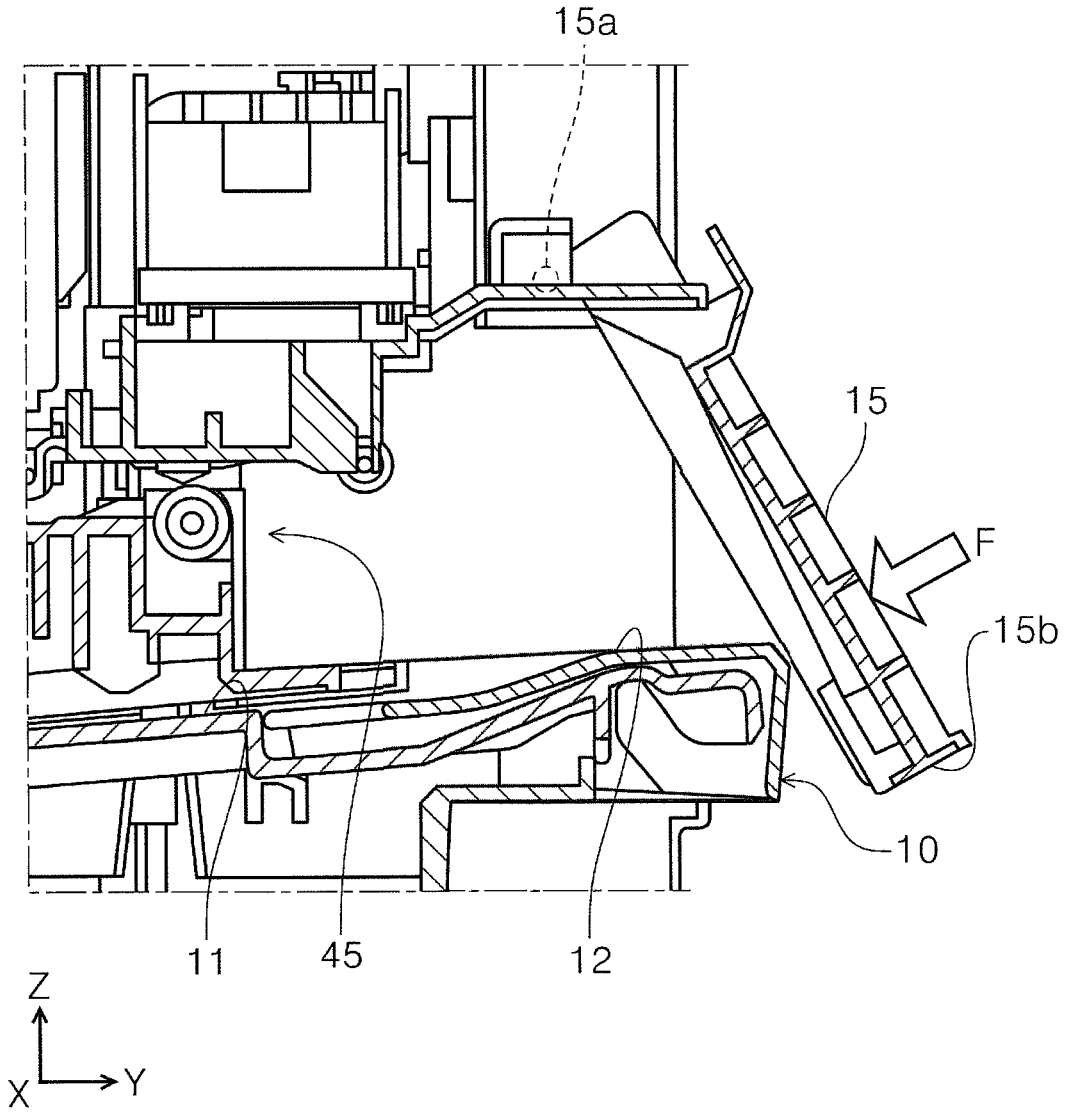
FIG. 8 is a sectional side view of a peripheral area of the cover in the printer according to the disclosure in which the cover is open, and the sheet output tray is housed.

Moreover, a cover 15 is provided as an "open/close structure" on the inner side of the operation panel 27 provided on the apparatus front surface. The cover 15 is openable, and FIGS. 2, 5 and 6 illustrate a state in which the cover 15 is closed, and FIGS. 3, 7 and 8 illustrate a state in which the cover 15 is open. In the present embodiment, there are two forms of the state in which the cover 15 is open, which will be described later. The cover 15, when open, allows an inner space 25 around the carriage 42 to be exposed under the operation panel 27 which has been tilted at least from the fully closed position into the horizontal direction as illustrated in FIGS. 3 and 4, and when closed, allows the inner space 25 to be closed as illustrated in FIG. 2. In the present embodiment, the inner space 25 includes a reciprocation area of the carriage 42. Further, the inner space 25 includes a paper sheet transport path from the transport roller pair 41 illustrated in FIGS. 5 and 6 to the downstream area.

As described above, the scanner unit 50 cannot be opened upward until the screw is removed. Accordingly, when a paper jam occurs inside the apparatus, the operation panel 27 and the cover 15 are opened to readily ensure an access path from the apparatus front side into the inner space 25 so that the paper jam can be removed. Here, since the operation panel 27 assumes a position that a user can easily operate when opened from the fully close position to a certain degree, it may remain in that position for a long period of time. When the operation panel 27 is held open to a certain degree for a long period of time, dust may enter the inside of the apparatus, which may damage a function of the apparatus. On the other hand, when the inner side of the operation panel 27 is formed of a fixed wall, a sufficient area cannot be ensured when a paper jam is removed from the apparatus front surface. However, by providing the openable cover 15, it is possible to reduce dust or the like entering the inside of the apparatus when the cover 15 is closed, and to improve accessibility to the inside of the apparatus when the cover 15 is open.

Further, the cover 15 can be opened/closed when the operation panel 27 is tilted upward, that is, an area that can be opened/closed is ensured when the operation panel 27 is tilted upward. In the present embodiment, the cover 15 is not opened/closed at least in cooperation with the tilting operation of the operation panel 27. In this sense, the cover 15 can be independently opened/closed. Accordingly, the cover 15 can be configured to be opened/closed in cooperation with components other than the operation panel 27. Further, in another configuration, in which the operation panel 27 is opened/closed by a power of motor or the like and a sensor for detecting an open/closed states of the operation panel 27 and the cover 15 is provided, the cover 15 can be configured to be automatically closed, for example, when the cover 15 is open for a predetermined period of time with the operation panel 27 being open for a predetermined period of time. In such a configuration, the cover 15 can be regarded as being opened/closed in cooperation with the state of the operation panel 27.

The cover 15 according to the present embodiment has a rotation shaft 15*a* (FIG. 7), which is a pivot center located in the lower part of the cover 15 which is in the closed state, and is configured to open forward relative to the apparatus with an upper part of the cover 15 in the closed state taken as a free end. In FIG. 7, reference number 15*b* denotes the free end of the cover 15. With this configuration, compared with the opposite configuration, that is, a configuration in which a pivot center is located in the upper part of the cover 15 in the closed state, and a lower part of the cover 15 in the closed state is taken as a free end when the cover 15 is opened, the cover 15 is less likely to interfere with access to the inside of the apparatus to thereby ensure easy access to the inside of the apparatus.

Further, as illustrated in FIGS. 7 and 3, the cover 15 in the present embodiment is configured to be open further downward from the horizontal plane. Accordingly, the cover 15 is less likely to interfere with access to the inside of the apparatus to thereby ensure easier access to the inside of the apparatus.

Further, in the present embodiment, the free end 15*b* of the cover 15 which is in the open state is supported by the sheet output tray 10 as illustrated in FIGS. 7 and 3. Accordingly, when an external force F is applied to the cover 15 in the open state, the sheet output tray 10 can support the cover 15 to thereby suppress breakage of the cover 15. In the present embodiment, the free end 15*b* of the cover 15 is configured to abut the tray main body 11 which constitutes the sheet output tray 10 when the sheet output tray 10 is in a protruded position. However, the free end 15*b* may not necessarily abut the sheet output tray 10 when the cover 15 is open, and a gap with a certain degree of opening may be formed between the free end 15*b* and the sheet output tray 10. That is, a gap with a certain degree of opening is acceptable as long as the free end 15*b* of the cover 15 is supported by the sheet output tray 10 before the cover 15 is detached or broken by the external force F applied thereto.

Further, the cover 15 may assume an open position illustrated in FIG. 8 in addition to the open positions illustrated in FIGS. 7 and 3. That is, when the sheet output tray 10 is in the retracted position, the cover 15 abuts an end of the sheet output tray 10 which is in the retracted position as illustrated in FIGS. 8 and 4 and a frame 9 exposed on the apparatus front surface, and is supported such that an open limit position is regulated. Accordingly, when the external force F is applied to the cover 15 which is in the open state as illustrated in FIG. 8, the cover 15 can be supported by the sheet output tray 10 which is in the retracted position and the frame 9 (FIG. 4) to thereby reduce the cover 15 being detached or broken. In the present embodiment, the cover 15 is supported by both the sheet output tray 10 and the frame 9. However, the cover 15 may be supported by either one of the sheet output tray 10 and the frame 9.

Further, the cover 15 in the open state as illustrated in FIGS. 7 and 3 closes an output path of a paper sheet which is outputted toward the sheet output tray 10. In FIG. 7, the line T2 indicates the output path of a paper sheet. With this configuration, a user can easily notice that the cover 15 is open, which makes it possible to reduce the cover 15 being left open, and reduce dust or the like entering the inside of the apparatus. Further, a form of the cover 15 closing the paper sheet output path T2 is not limited to a form in which the cover 15 fully closes the paper sheet output path T2. It is only required that the cover 15 interferes with the paper sheet output path T2 and is in contact with a paper sheet which is outputted.

Figure 10:
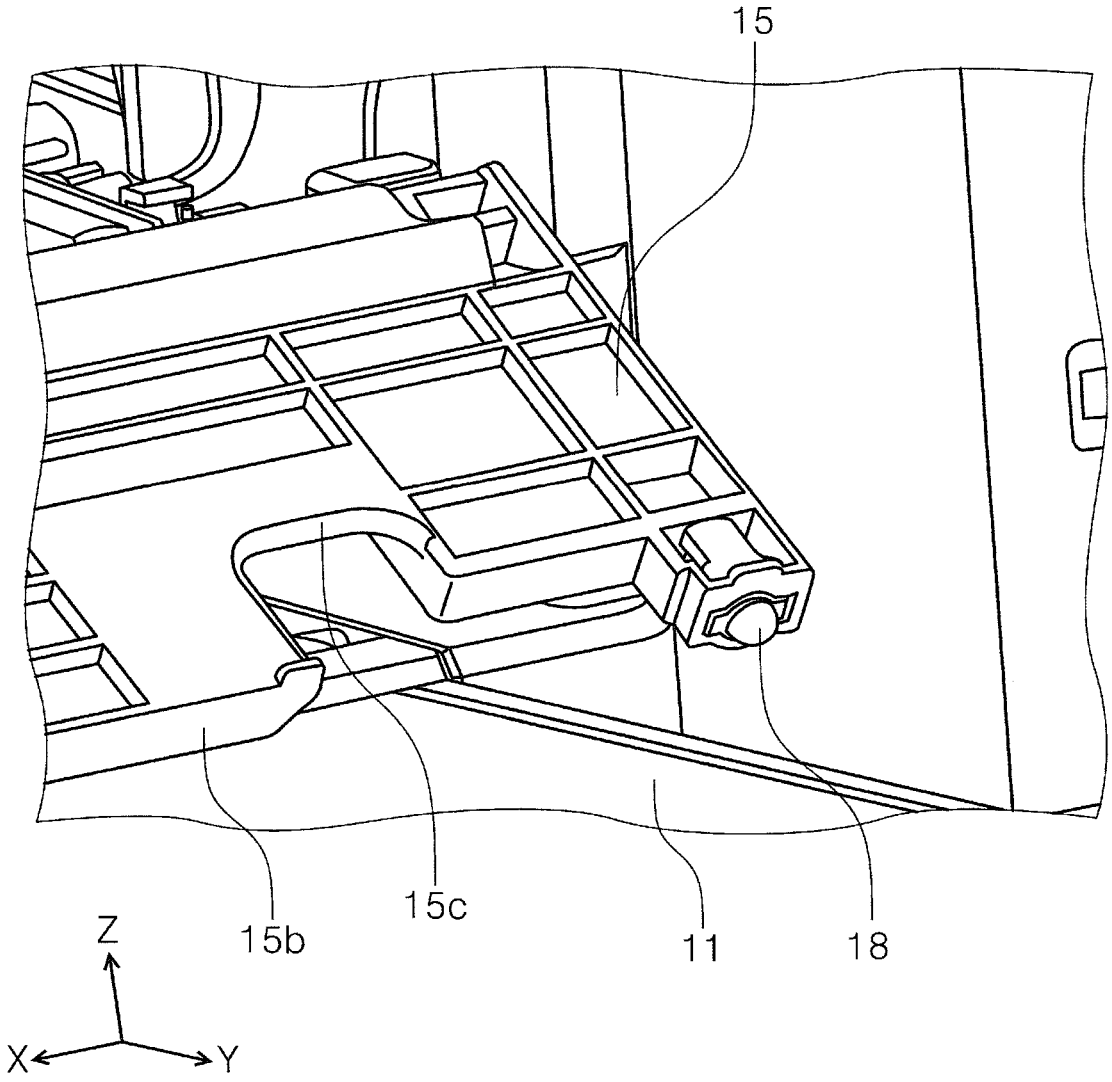
FIG. 10 is a perspective view of a peripheral area of the cover end (lock pin) in the printer according to the disclosure in which the cover is open, and the sheet output tray is pulled out.

Further, in the present embodiment, a lock unit 16 is provided to lock the cover 15 in the closed state as illustrated in FIG. 11. The lock unit 16 includes a lock pin 18 and a spring 17. The lock pin 18 protrudes from the free end 15*b* of the cover 15 as illustrated in FIG. 10, and is configured to be slidably displaced relative to the cover 15 to that the protruded amount varies. The spring 17 presses the lock pin 18 in a protruded direction. As illustrated in FIG. 11, an engagement section 57*a* is disposed on a frame 57 which constitutes the scanner unit 50 so that the lock pin 18 can engage with the engagement section 57*a* when the cover 15 is closed. When the cover 15 is closed, the lock pin 18 is first retracted resisting against a pressing force from the spring 17, and then protrudes to thereby assume a lock state as illustrated in FIG. 11. Thus, by providing the lock unit 16 that allows the cover 15 to be locked in the closed state, the cover 15 can reliably remain closed.

Further, in the present embodiment, as illustrated in FIG. 11, the free end 15*b* of the cover 15 in the closed state is located at a position between the scanner unit 50 and the operation panel 27 in the apparatus depth direction. Accordingly, it is possible to prevent the cover 15 from being unintentionally opened.

In addition, the cover 15 according to the present embodiment includes a hand grip 15*c* as illustrated in FIGS. 3, 4, 9 and 10. In the present embodiment, the hand grip 15*c* has a shape of a notch on the free end 15*b* of the cover 15. Since the cover 15 includes the above hand grip 15*c*, operability in opening and closing the cover 15 is improved.

Figure 9:
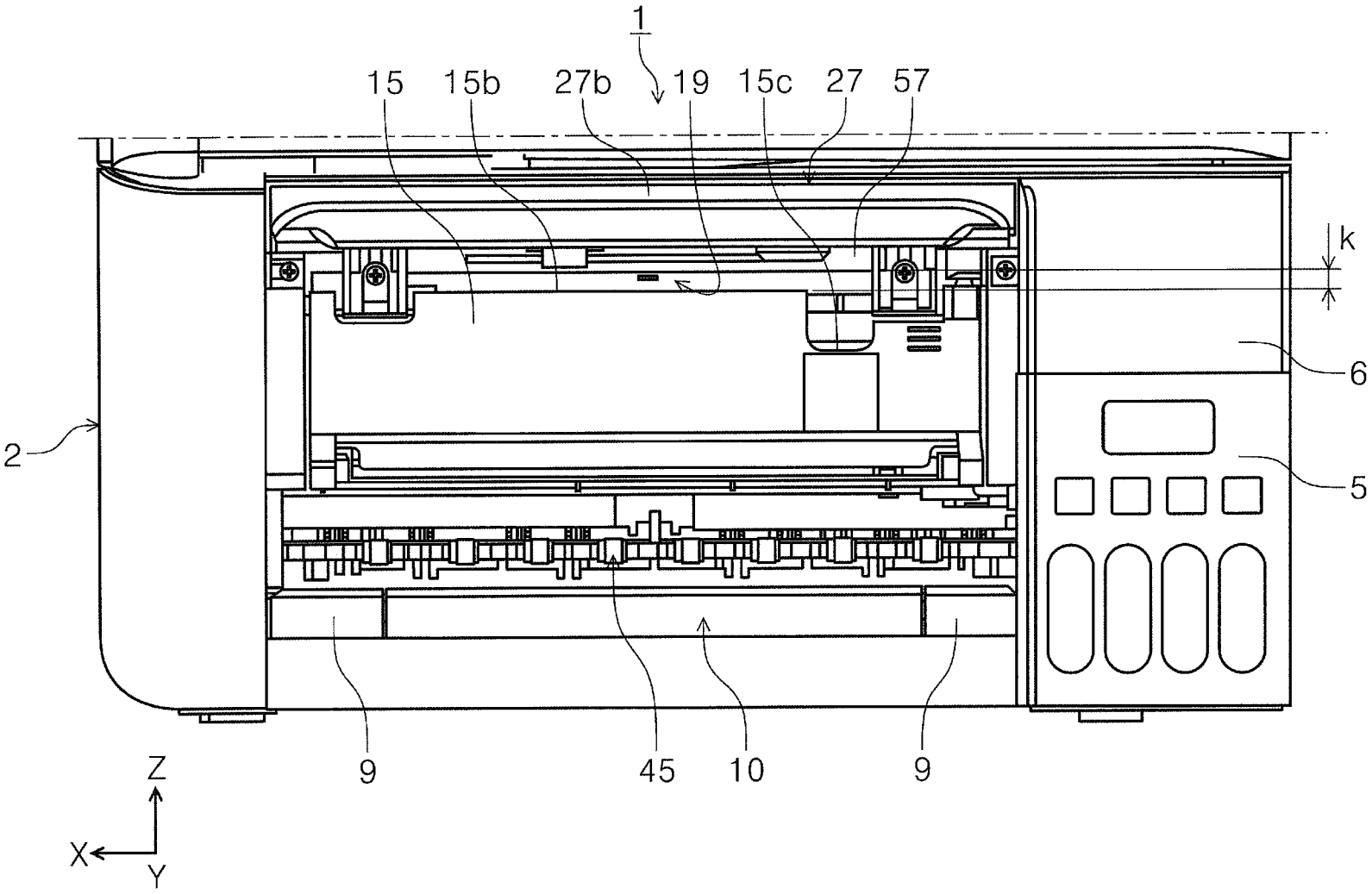
FIG. 9 is a front view of the printer according to the disclosure in which the operation panel is open, the cover is closed, and the sheet output tray is housed.

In addition, in the closed state of the cover 15, the free end 15*b* faces the frame 57 which constitutes the apparatus main body 2 as illustrated in FIGS. 9 and 5. Further, if a gap 19 between the free end 15*b* and the frame 57 is not ensured to a certain degree, the free end 15*b* may abut the frame 57 due to manufacturing tolerance or assembly tolerance of components, which disturbs the cover 15 from being closed. Therefore, a dimension k of the gap 19 is ensured to a certain degree. In addition, as illustrated in FIG. 9, since the hand grip 15*c* is formed on the free end 15*b*, the gap 19 is also used as a hand grip area. With this configuration, the depth of the notch forming the hand grip 15*c* can be minimized to thereby reduce dust or the like entering inside of the apparatus main body. In addition, the hand grip 15*c* may not be limited to a notch shape, but may also be formed as a protrusion in a hand grip shape or a pull string provided on the front surface of the cover 15. With this configuration, it is possible to reduce dust or the like entering the inside of the apparatus main body in a more reliable manner without forming a hole or notch for hand grip in the cover 15.

The disclosure is not limited to the aforementioned embodiments, and various modifications can be made within the scope of the disclosure as set forth in the claims. Such modifications are also intended to fall within the scope of the disclosure.

What is claimed is:

1. A recording apparatus comprising:

a recording section that performs recording onto a medium;

an operation panel which is provided to be tilted on an apparatus front surface, and is configured to be tilted to switch between a first position and a second position which is closer to a horizontal position than the first position is; and an open/close structure configured to be opened/closed, and configured to, when open, expose a space around a recording unit under the operation panel which has been tilted at least from the first position into a horizontal direction, and, when closed, close the space around the recording unit, wherein the open/close structure is located at a position between the operation panel and the recording section in an apparatus depth direction.

2. The recording apparatus according to claim 1, wherein the open/close structure has a pivot center in a lower part of the open/close structure in a closed state, and is configured to open forward relative to the apparatus with an upper part of the open/close structure in the closed state taken as a free end.

3. The recording apparatus according to claim 2, wherein the open/close structure is configured to be open further downward from a horizontal plane.

4. The recording apparatus according to claim 3, further comprising:

a medium receiving tray under the open/close structure, the medium receiving tray being configured to receive a medium outputted after recording is performed on the medium, wherein the free end of the open/close structure which is in an open state is supported by the medium receiving tray.

5. The recording apparatus according to claim 4, wherein the open/close structure in the open state closes an output path for the medium outputted toward the medium receiving tray.

6. The recording apparatus according to claim 3, further comprising:

a medium receiving tray under the open/close structure, the medium receiving tray being configured to be displaced between a retracted position and a protruded position, which is a position protruded forward relative to the apparatus from the retracted position, and configured to receive a medium outputted after recording is performed on the medium, wherein the open/close structure in an open state is supported by the medium receiving tray in the retracted position or supported by a frame exposed on the apparatus front surface.

7. The recording apparatus according to claim 2, further comprising:

an upper unit disposed above the recording unit that includes the recording section, wherein the free end of the open/close structure in the closed state is located at a position between the upper unit and the operation panel in the apparatus depth direction.

8. The recording apparatus according to claim 1, further comprising a lock unit that locks the open/close structure in a closed state.

9. The recording apparatus according to claim 1, wherein the open/close structure includes a hand grip.

* * * * *